US008286621B2

(12) United States Patent
Halmone

(10) Patent No.: US 8,286,621 B2
(45) Date of Patent: Oct. 16, 2012

(54) PNEUMATICALLY POWERED PROJECTILE LAUNCHING DEVICE

(75) Inventor: Fabrice N. V. Halmone, Ville La Grand (FR)

(73) Assignee: Kingman International Corporation, Baldwin Park, CA (US)

( * ) Notice: Subject to any disclaimer, the term of this patent is extended or adjusted under 35 U.S.C. 154(b) by 0 days.

(21) Appl. No.: 13/008,725

(22) Filed: Jan. 18, 2011

(65) Prior Publication Data

US 2011/0114072 A1 May 19, 2011

Related U.S. Application Data

(62) Division of application No. 11/624,895, filed on Jan. 19, 2007, now Pat. No. 7,870,852.

(51) Int. Cl.
*F41B 11/00* (2006.01)

(52) U.S. Cl. ..... 124/74; 124/77

(58) Field of Classification Search ..... 124/74, 124/77

See application file for complete search history.

(56) References Cited

U.S. PATENT DOCUMENTS

| | | | | |
|---|---|---|---|---|
| 5,542,406 | A * | 8/1996 | Oneto | 124/73 |
| 5,613,483 | A | 3/1997 | Lukas et al. | 124/73 |
| 5,769,066 | A | 6/1998 | Schneider | 124/75 |
| 6,601,780 | B1 | 8/2003 | Sheng | 239/337 |
| 6,644,295 | B2 | 11/2003 | Jones | 124/77 |
| 6,892,718 | B2 | 5/2005 | Tiberius et al. | 124/74 |
| 7,591,262 | B2 | 9/2009 | Jones et al. | 124/77 |
| 7,597,097 | B2 | 10/2009 | Gan | 124/77 |
| 7,640,926 | B2 | 1/2010 | Jones | 124/74 |
| 7,870,852 | B2 * | 1/2011 | Halmone | 124/77 |
| 2003/0005918 | A1 | 1/2003 | Jones | 124/70 |
| 2005/0115554 | A1 | 6/2005 | Jones | 124/74 |
| 2006/0169266 | A1 | 8/2006 | Carnall et al. | 124/75 |
| 2007/0028909 | A1 | 2/2007 | Wood | 124/73 |
| 2007/0181115 | A1 | 8/2007 | Jong | 124/73 |
| 2008/0173291 | A1 * | 7/2008 | Halmone | 124/77 |
| 2010/0083944 | A1 | 4/2010 | Dobbins | 124/73 |
| 2010/0101551 | A1 | 4/2010 | Gardner et al. | 124/77 |

* cited by examiner

*Primary Examiner* — Michael David

(74) *Attorney, Agent, or Firm* — Blakely, Sokoloff, Taylor & Zafman LLP

(57) ABSTRACT

The pneumatically powered projectile launching device has a bolt located within a body. A front gas chamber in the body has an opening through which the bolt extends into the chamber. The bolt can move forward and backward thereby changing the volume of the front chamber. The bolt has a backward facing working surface. A gas valve in the body selectively releases compressed gas into the chamber. The released gas applies pressure on the backward facing working surface of the bolt to move the bolt forward, and then passes through a passage in the bolt to pneumatically force the projectile to leave the device. Other embodiments are also described and claimed.

6 Claims, 8 Drawing Sheets

PNEUMATICALLY POWERED PROJECTILE LAUNCHING DEVICE

This patent application is a divisional of application Ser. No. 11/624,895, filed on Jan. 19, 2007, entitled PNEUMATICALLY POWERED PROJECTILE LAUNCHING DEVICE.

An embodiment of the invention is directed to pneumatically powered projectile launching devices, such as paintball markers. Other embodiments are also described.

BACKGROUND

Guns using pneumatic force to propel a projectile are well known. Typically, a volume of compressed gas, such as carbon dioxide gas, is suddenly released into a barrel that contains the projectile. The expansion of the released gas propels the projectile through the barrel at relatively high velocity. In the recreational sport of paintball, the projectile is spherical and frangible, and contains a colored liquid or gel material which leaves a mark on the target upon the projectile's impact with the target. Such guns are referred to as paintball markers.

A typical paintball marker design has a body which houses and interconnects several pneumatic components. The body may contain a number of bores that communicate with each other. One bore may contain and distribute pressurized gas. Another bore (that is parallel to the other) may contain a compressed gas storage chamber, as well as mechanisms for filling the storage chamber with gas and releasing gas from the storage chamber to fire a projectile. Yet another bore may contain mechanisms for loading and launching the projectile. Electrically operated pneumatic flow distribution devices are added that are sequentially energized by a timing circuit, to enable the loading of a projectile and to release compressed gas to fire the projectile.

Conventional paintball marker designs have sought to provide reliable and consistent performance in loading and firing paintballs. Such attempts, however, have resulted in designs that may be overly complicated, leading to questionable reliability as well as higher manufacturing costs.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

FIGS. 5-8 show different stages of a launching sequence for the embodiment of FIG. 3, including movement of the piston, bolt and projectile.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, the references made below to spatial orientation, such as "forward", "backward", "left", "right", "above" and "below", should be viewed as relative terms and not absolute terms.

Figure 1:
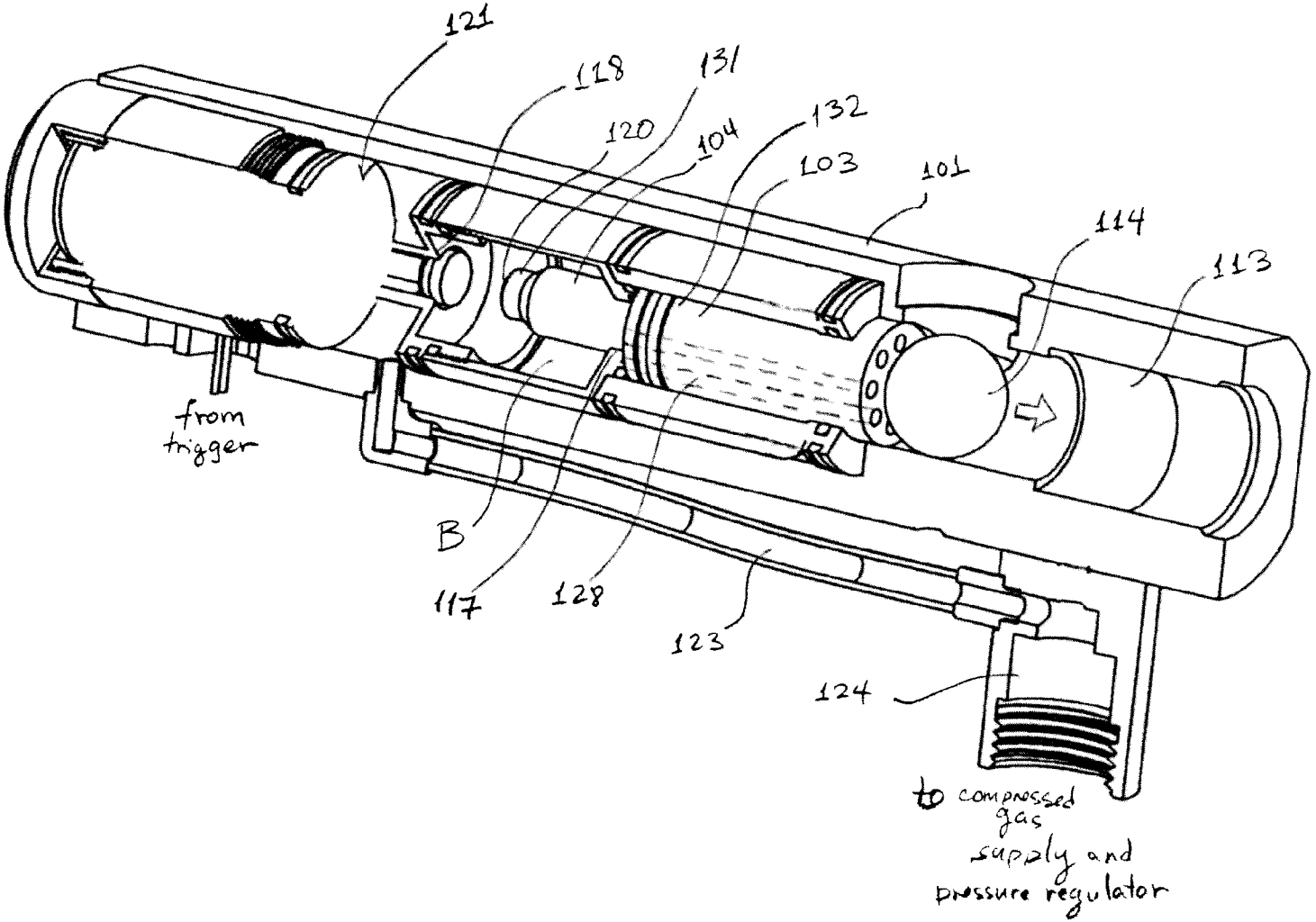
FIG. 1 is a cutaway, elevation view of a pneumatically powered projectile launching device in accordance with an embodiment of the invention.

The embodiments of the invention are directed to pneumatically powered projectile launching devices that have reduced parts count, thereby saving materials and making the device easier to assemble and maintain, without compromising on performance and reliability. FIG. 1 is a cutaway, elevation view of such a device, in accordance with an embodiment of the invention. The device has a body 101 in which is located a gas chamber B (also referred to as the forward chamber or the main gas chamber). The body 101 may be a single piece of metal or other suitable material in which openings have been formed, and into which internal components have been inserted, to define the chamber B (and any gas flow passages or channels described below).

The chamber B is sized to hold a volume of compressed gas needed to launch a projectile 114. An opening 118, to fill the chamber B with compressed gas, is located, in this example, at the rear end of the chamber B. At its forward end, opposite the rear end, there is another opening 117 through which a bolt 103 extends. The size and shape of this opening 117 is designed to mate with the outside surface of a middle portion 104 of the bolt 103, to yield an interface that prevents meaningful leakage of compressed gas from the chamber B past the outside surface of the bolt 103. At the same time, the interface allows the bolt to move back and forth in its longitudinal direction, as described below, which in effect changes the volume of the chamber B.

The bolt 103 has a backward facing working surface 120. A working surface as understood here is generally transverse to a longitudinal axis of the component (here, the bolt 130), but the entire surface is not required to be perpendicular to the longitudinal axis. The working surface of a component is designed to be subject to pneumatic pressure, from a compressed gas, for moving the component.

With the bolt 103 in its full backward position as shown, a breech region is located forward of the bolt and into which the projectile 114 has seated. In this embodiment, the projectile 114 passes from outside the body 101, through an opening above the bolt 103, and into the breech region, once the bolt has moved back to its full backward position. This seating of the projectile 114 may be accomplished by a projectile magazine that is feeding projectiles sequentially into the breech region. A barrel 113 of the device is located forward of the breech region and into which the breech region opens. Launching the projectile 114 calls for the bolt 103 moving forward to push the projectile 114 from the breech region into the barrel 113, and then, through application of pneumatic force of the released compressed gas, shooting the projectile out of the barrel 113 in the forward direction. An example configuration of the bolt that can achieve this launching sequence is described next.

The bolt 103 has a back portion 131 in which the backward facing working surface 120 is formed at the rear end. The back portion in this example is cylindrical. Next, further forward (in the direction the projectile 114 is launched), there is a middle portion 104 which has an outer diameter that is greater than that of the back portion 131. The length of the middle portion 104 is designed in view of the size of the breech region and the projectile 114. Located further forward of the middle portion, the bolt 103 also has a front portion 132 having a greater outer diameter than that of the middle portion 104. One or more gas passages or gas channels 128 are formed in the front portion 132, where at least the majority of each of the passages 128 is inside the bolt and not on its longitudinal, outside surface (as indicated by the dotted lines). Each passage connects an opening in a forward facing surface of the front portion 132, to an opening in a backward facing surface of the bolt that is located between, or at the junction of, the middle and front portions of the bolt.

The device in FIG. 1 also has a gas valve 121 located within the body 101, to selectively release compressed gas into the chamber B. The opening 118 in the rear end of the chamber B may be part of the valve 121, and in particular its outlet. An inlet of the valve 121 may be connected to a compressed gas supply by a channel 123. The supply may be, for example, a carbon dioxide canister with a pressure regulator (not shown), which supplies the needed compressed gas through a gas fitting 124. The fitting 124 may be fixed to the body 101 and is in communication with the channel 123. FIG. 1 shows an example of such a combination, for holding a vertical gas source below the body 101. Other types of compressed gas supplies and fitting arrangements may be used.

Figure 2:
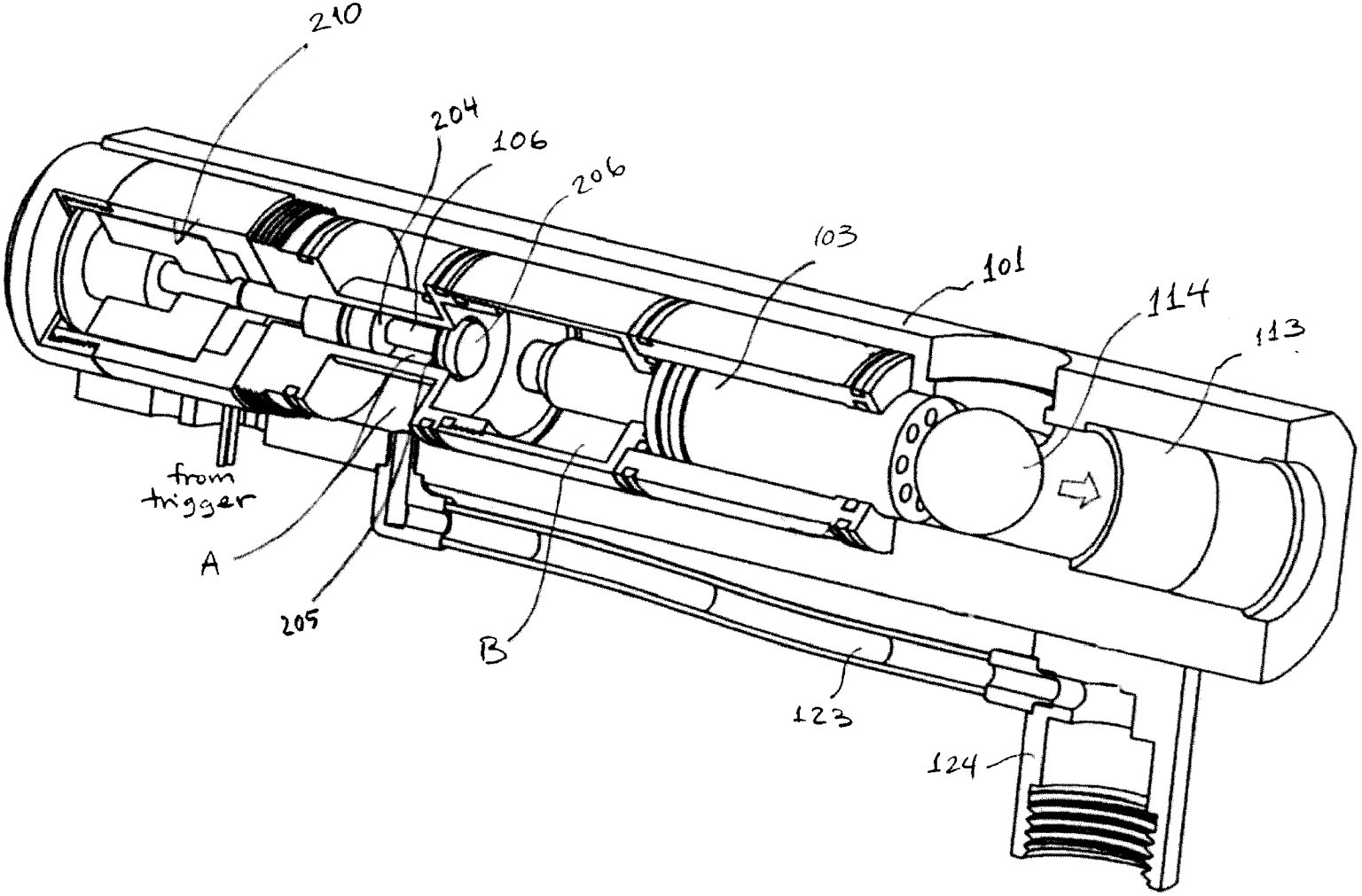
FIG. 2 is a cutaway, elevation view of another embodiment of the invention.

The valve 121 may be normally closed, in this example thereby closing off the chamber B when the middle portion 131 of the bolt 103 is in position against the opening 117 as shown. The valve 121 may then be manually actuated by a trigger being pulled by the user of the device. Alternatively, the valve 121 may be a solenoid valve that opens in response to a timed, electrical trigger signal. FIG. 2 described below illustrates yet another alternative for the valve 121.

Using the arrangement in FIG. 1, the compressed gas, once released into the chamber B (by the valve 121 responding to the trigger being squeezed), performs at least two things. First, it applies pressure on the backward facing working surface 120 of the bolt 103 to move the bolt forward. Then, once the bolt 103 has moved sufficiently forward, such that the rear end of its middle portion 131 clears the opening 117 (and the smaller diameter back portion 131 enters the opening 117), the compressed gas passes through the opening 117 and then through one or more passages 128 in the bolt, to then pneumatically force the projectile 114 to leave the device through the barrel 113. This two-stage launch sequence makes efficient use of the compressed gas. It can be implemented in a paintball marker, for example, by the configuration of the bolt 103, breech region, and barrel shown in FIG. 3 (to be described later below).

Figure 3:
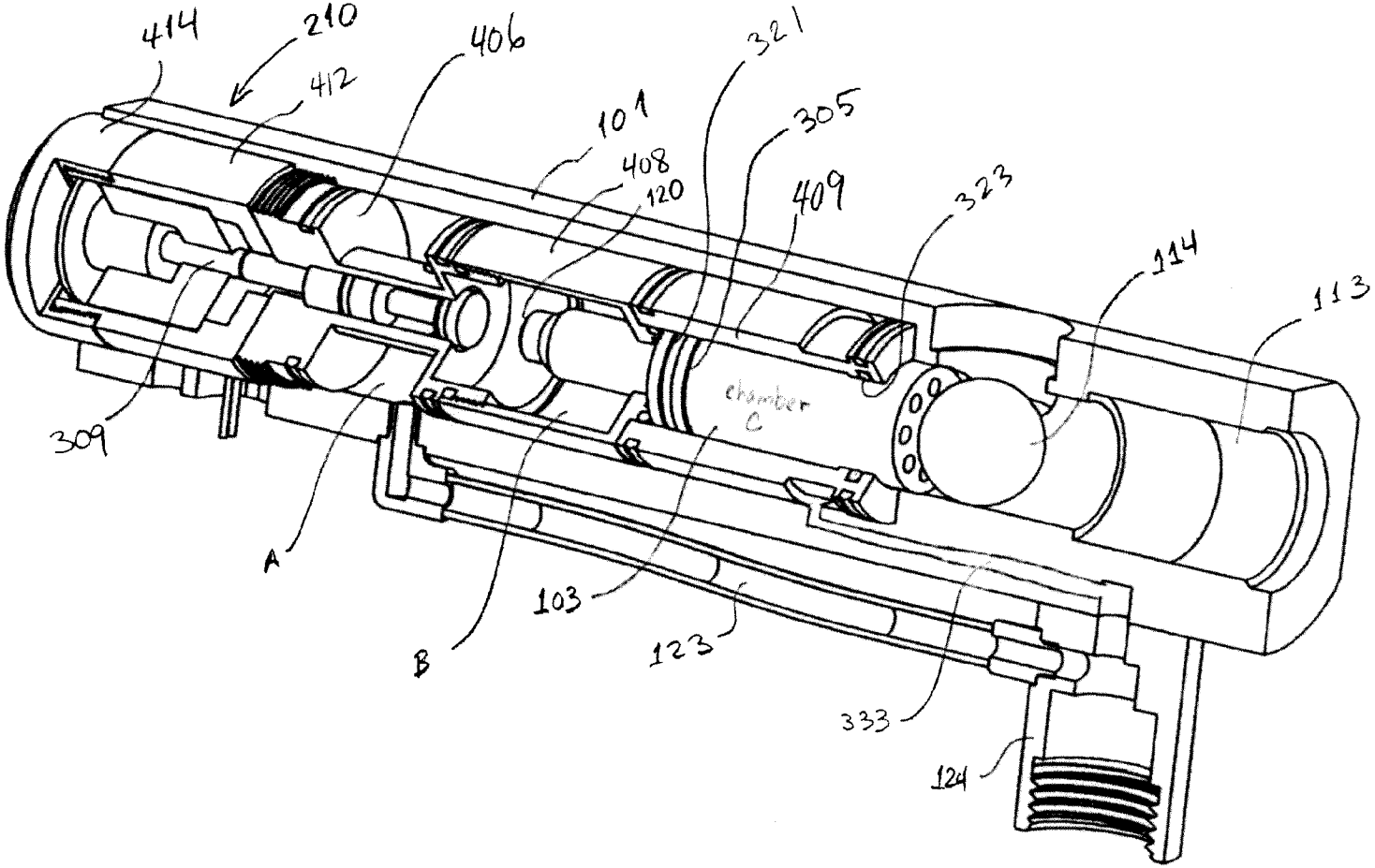
FIG. 3 is a cutaway, elevation view of yet another embodiment of the invention.

Note that to bring the bolt 103 back to its cocked or full backward position, the bolt may be biased backwards, by a mechanical spring (not shown) that has the force needed to push or pull the bolt back (once the pressure in chamber B has dropped to a sufficiently low level). FIG. 3, described below, shows another mechanism that can be used to move the bolt back automatically, and without using a mechanical spring.

Turning now to FIG. 2, another embodiment of the invention is shown, by a cutaway elevation view. This embodiment may use most of the elements described above in connection with FIG. 1 (or other suitable elements), and in addition has a particular type of valve 121. A gas chamber A (also referred to here as the back chamber) is located within the body 101, in this example directly behind the chamber B. Chamber A is also sized to hold a volume of compressed gas that is needed to launch the projectile 114. A piston and its sleeve (also referred to as a pilot) is located within chamber A. The piston is movable along it's longitudinal axis between a closed position and forward to an open position. The piston 106 is to selectively close and open a gas path that connects chamber A with chamber B, where this gas path may include opening 118 of chamber B (see FIG. 1). In the preferred embodiment, the volume of chamber A, that is, the volume which is available within the body 101 (exclusive of the channel 123 that is used to fill the chamber A from a supply) to hold the compressed gas, is no less than 80% of the available volume in chamber B (e.g., the available volume in chamber B with the bolt 103 in its full backward position as shown). This provides the needed pneumatic force to launch the projectile 114.

The piston 106 has a forward facing first working surface 204, and a backward facing second working surface 205, where the latter is spaced forward of the working surface 204 as shown. The piston 106 also has a forward facing third working surface 206 that is spaced forward of the surface 205 as shown. The surface 206 is located within chamber B, while the surfaces 204 and 205 are located within chamber A. An electromechanical transducer 210 is also located in the body 101, in this example directly behind and in line with the longitudinal axis of the piston 106, and is coupled to move the piston 106 forward to the open position in response to a launch trigger signal.

In one embodiment, the piston's forward facing first working surface 204 has essentially equal area as the backward facing second working surface 205. This, together with a pair of o-ring seals, in this example fitted to the outside surface of the piston 106 inside the sleeve, one behind the surface 204 and one in front the surface 205, which prevent meaningful leakage from chamber A, help maintain the piston 106 in position even if the device were to, for example, be dropped by the user and hit the ground. The equal force applied in the forward and backward directions (on the two working surfaces 204, 205) simultaneously by the compressed gas (received through the channel 123) tends not to apply any net longitudinal force to the piston 106. Forward movement of the piston 106, in this embodiment, is therefore only caused by the transducer 210 being actuated, in response to an electrical launch signal (trigger signal), pushing the piston 106 from behind the working surfaces 204, 205.

Opening the gas path causes the release of compressed gas from chamber A into chamber B. As chamber B fills up with the compressed gas, pressure on the forward facing working surface 206 of the piston increases and eventually pushes the piston 106 back to its closed position (closing the opening 118, see FIG. 1). The area of the surface 206 should thus be designed to allow enough force to be generated by the compressed gas in chamber B, to overcome any friction between the seals of the piston 106 and the surrounding piston sleeve. In addition, the transducer 210 should be designed and operated so that the piston 106, once it has moved forward to the open position, is essentially released and is thereafter free to move backwards in response to the expanding gas and mounting pressure in chamber B. This allows the off/on/off pulsing of the piston 106, to release a certain volume of the compressed gas into the chamber B. Note that once the piston 106 has moved back to its closed position, chamber A may again refill with compressed gas via channel 123.

Figure 4:
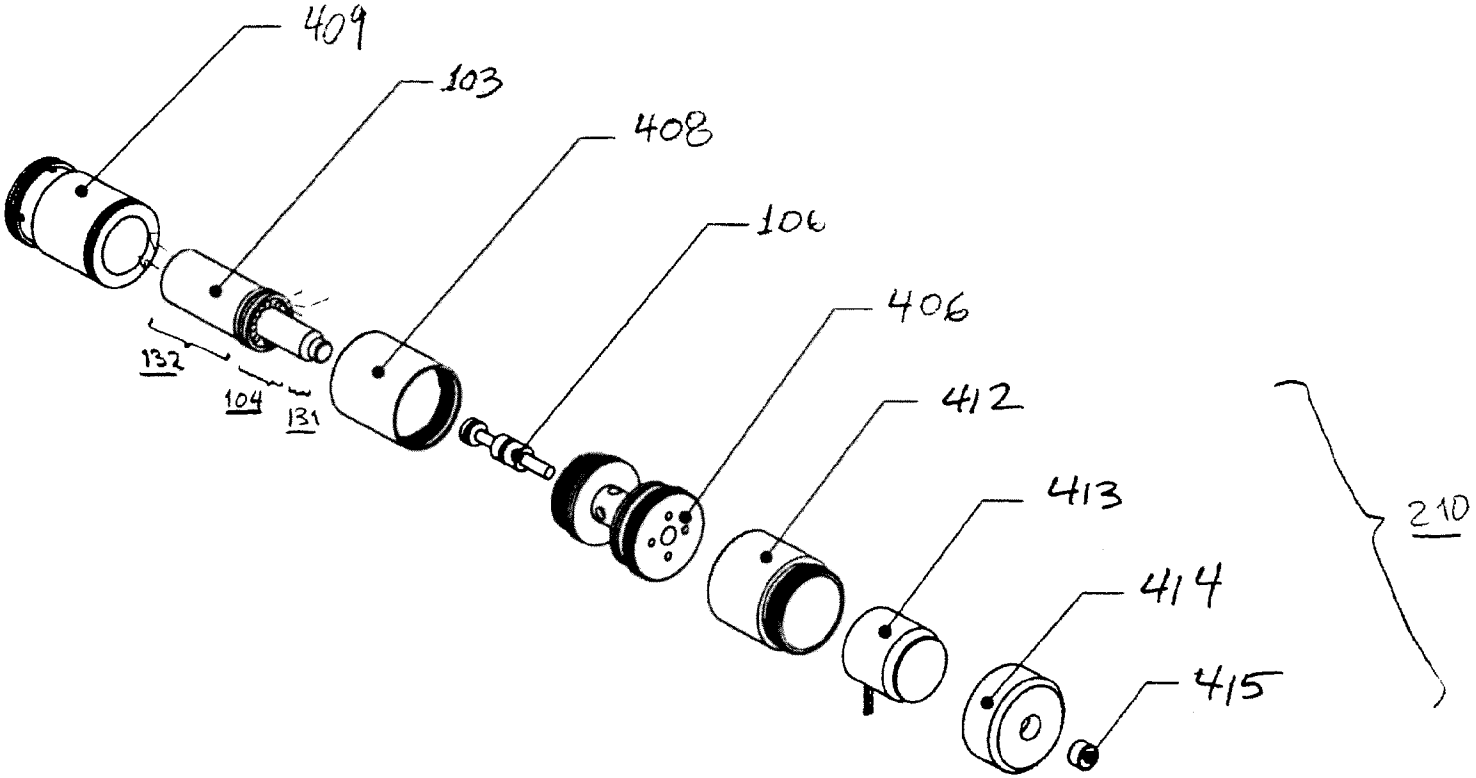
FIG. 4 is an exploded view of some of the parts of the embodiment of FIG. 3.
Figure 5:
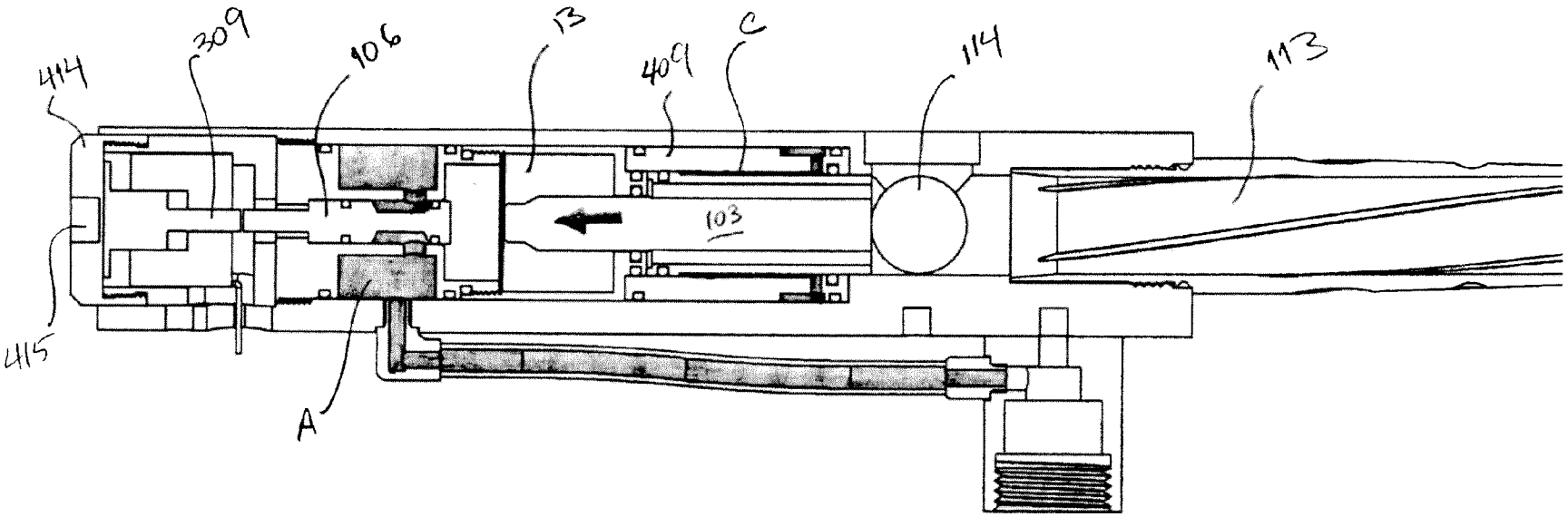

Turning now to FIG. 3, a cutaway, elevation view of yet another embodiment of the invention is shown. In this embodiment, many of the elements and features described above in connection with FIGS. 1 and 2 are combined in a way that renders the device particularly effective as a high performance, reliable, and simple to manufacture paintball marker. In this case, the body 101 is designed with a single, round bore in which the transducer 210, chamber A, chamber B, and a further chamber, chamber C, are located side-by-side in that sequence. FIG. 4 shows an exploded view or parts list of some of the components that fit on or inside of the single bore within the body. These parts are designed to fit into the bore by sliding into position within the bore and be fixed in that position. O-ring seals should be fitted either around the outside surface or the inside surface of a component, if needed to prevent meaningful leakage of the compressed gas across component interfaces. Components in this embodiment include a back chamber housing 406 including a piston sleeve in which the piston 106 is constrained to only move in its longitudinal direction, a front chamber housing 408 in which the front chamber (chamber B) is located, and a bolt sleeve or bolt housing 409 that constrains the bolt 103 to only move in its longitudinal direction. FIG. 4 also shows an example of the components used in the transducer 210, including a coil housing 412, coil assembly 413, coil housing plug 414, and magnet 415. The manner in which these components operate relative to each other will be described further below.

In the embodiment of the invention depicted in FIG. 3, a different mechanism is used for moving back or recoiling the bolt 103 (to enable the loading of the next projectile 114). The bolt 103 in this case extends into a chamber C that is in front of chamber B. The outside surface of the bolt 103 is configured with a forward facing working surface 305. The working surface 305 is formed in the front portion 132 of the bolt (see FIG. 4). The chamber C in this example is defined by the outside surface of the front portion 132, the forward facing working surface 305, and the inside wall of the bolt sleeve 409. Note that an o-ring seal 321 behind the surface 305, and an o-ring seal 323 in front may be provided to prevent meaningful leakage of compressed gas from the chamber C. In this example, the seal 321 is fitted into a corresponding groove in the outside surface of the bolt 103, while the seal 323 is fitted to the inside surface of the bolt sleeve 409. Other arrangements for sealing the chamber C are possible. The surface 305 in effect becomes a moveable wall of the chamber C, where the available volume of chamber C changes in response to the bolt moving forwards and backwards.

The chamber C is to hold a volume of compressed gas needed to apply pressure on the forward facing working surface 305, to move the bolt 305 to its full backward position. The source for this compressed gas may be the same as that provided through the fitting 124, via a gas channel 333 formed, in this example, within the body 101. Thus, in this example, chambers A and C are at the same pressure of compressed gas, by virtue of being run off the same pressure regulator. Alternatively, chambers A and C can be run at different pressures, perhaps using multiple regulators.

It should be noted that the forward facing working surface 305 of the bolt should be sized or balanced, relative to the backward facing working surface 120 of the bolt (which is used to do the work in moving the bolt forward), to not resist too much the forward movement of the bolt when launching the projectile, yet enable a sufficiently rapid recoil of the bolt to, for example, support rapid, semiautomatic firing. The manner in which compressed gas is routed to the chamber C as depicted in FIG. 3, puts essentially constant pressure on the forward facing working surface 305, during normal operation of the paintball marker. As an example, the pressure on the surface 305 remains essentially unchanged during the following interval: between when a) the bolt is moved to its full backward position and a paintball is loaded into the breech region of the marker, and b) the bolt is moved forward to push the loaded paintball into the barrel of the marker and compressed gas released from chamber B passing through the bolt launches the paintball from the barrel. This constant pressure may also be applied during multiple, consecutive firing sequences. This aspect of the invention obviates the need for biasing the bolt using a mechanical spring for instance. The reference to constant here depends on the output of the pressure regulator (if any) that feeds the gas channel 333.

Although being a function of the pressures that are applied to chamber A and C, the area of the backward facing working surface 120 of the bolt should be greater than that of the forward facing working surface 305 so that the compressed gas being released into chamber B can efficiently launch the paintball 114 without encountering too much resistance in the opposite direction.

Before describing operation of the embodiment in FIG. 3 using an example firing sequence, a further description of the transducer 210 is given. In this particular embodiment, the transducer 210 has a coil assembly 413 that receives an electrical signal in response to the user squeezing a trigger of the device. This signal energizes the coil which in turn causes a "floating" pin 309 to be moved forward, thereby pushing the piston 106 forward into the open position. Once de-energized, the magnet 415 behind the pin 309 uses magnetic force to pull the pin 309 back, and keeps the pin 309 in its full backward position until the next trigger cycle. Other arrangements for the transducer 210 are possible.

As an alternative to the floating pin design, the rear end of the piston 106 may extend back into the coil assembly such that no separate pin is needed. The piston 106 can alternatively be biased by a mechanical spring in its backward (closed) position. In yet another embodiment, the surfaces 204, 205 of the piston have a sufficiently different area (including different diameters) that allows the piston to remain in the closed position, without having to use a mechanical spring and without having to attach the piston to the pin 309. Thus, if surface 204 were larger than surface 205, then whenever the device is put under pressure, i.e. in this case the chamber A is filled with compressed gas, the piston will be kept in its default, closed position until the transducer 210 is actuated by a trigger signal. The surfaces 204, 205 may be designed so that the piston remains closed (when the pressure is on in chamber A), even if the user allows the device to fall to the ground by accident.

Turning now to FIGS. 5-8, these figures show different states of the device of FIG. 3, in an example launching sequence. Beginning with FIG. 5, this figure shows the device with the bolt 103 in its full backward or cocked position, with a projectile 114 seated in the breech region in front of the bolt. The figure also shows chamber A, located around the piston housing, being shaded to indicate that it is full of compressed gas. Chamber B is empty of the compressed gas, and chamber C, located in the gap between the bolt 103 and the bolt sleeve, is filled with compressed gas. There is a constant pressure of gas provided to both chambers A and C. Chamber A is closed by the piston 106 in the position shown. The pressure in chamber C has pushed the bolt to its back position and holds the bolt there, thereby allowing the projectile 114 to seat in the breech of the paintball marker. The coil pin 309 is under control of an electronic circuit that responds to the squeezing of the trigger. A magnet 415 housed in the coil plug 114, which in this case threadingly engages the body to hold the components against each other, is provided to recall the pin 309 back to the position shown in FIG. 5 (once the coil is de-energized following the trigger having been pulled).

Figure 6:
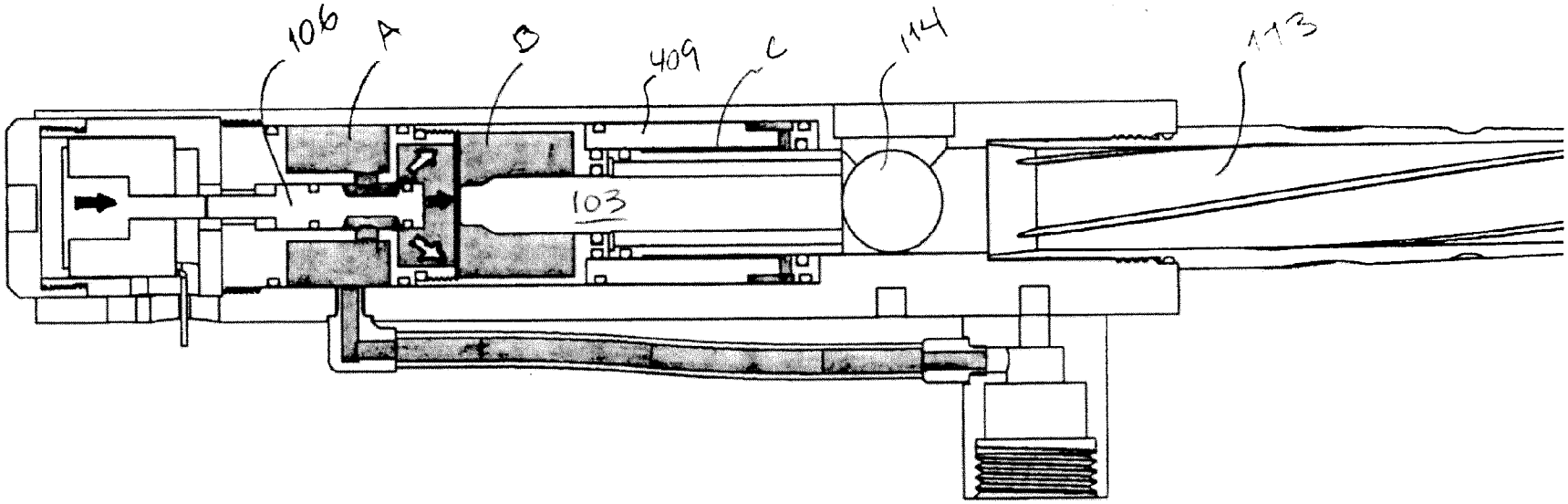
Figure 4:
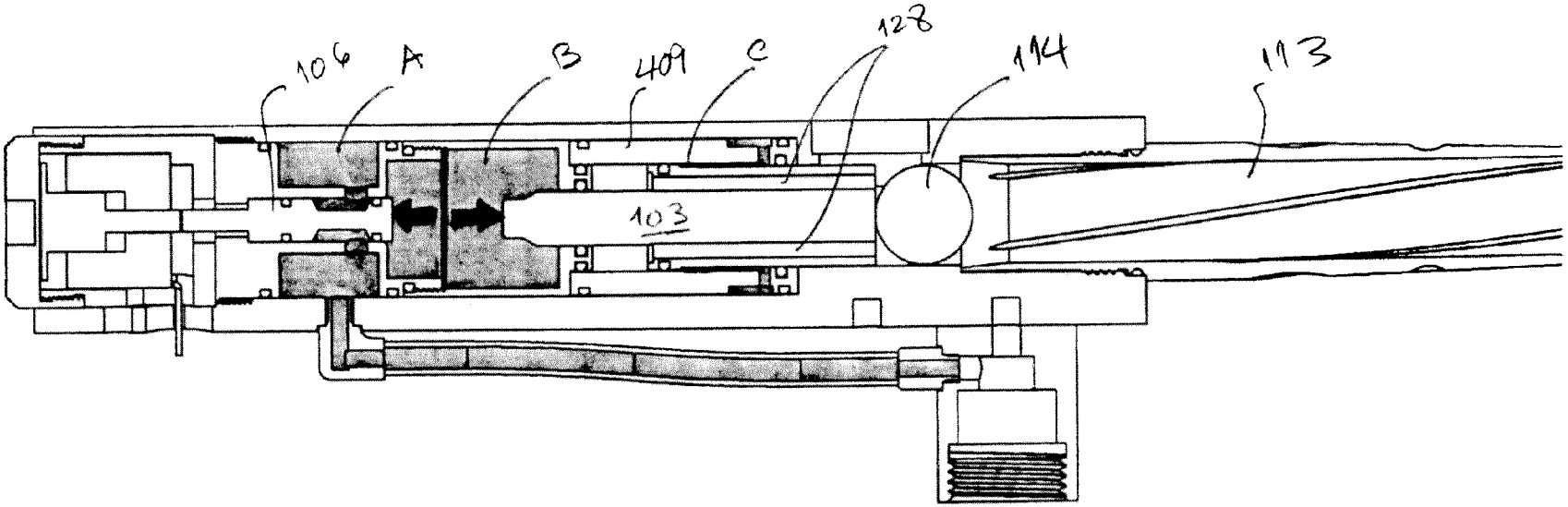

In response to pulling the trigger, a circuit board sends current though the coil and energizes the coil. The point in time at which this current is sent to the coil can be adjusted. The coil once energized moves the coil pin 309 forward which, in this embodiment, after closing a small gap, pushes against the rear end of the piston 106. This in turn causes the piston 106 to progress further into chamber B, thereby opening the gas passage between chamber A and chamber B. This is depicted in FIG. 6, as the compressed gas is released into the chamber B. Pressure in chamber B rises towards that of chamber A, and as the chamber B fills up, the pressure in that chamber is pushing on the backward facing working surface of the bolt 103, as shown by the arrow. The electrical signal that has energized the coil is now cut off, and the piston 106 is free to move back in response to pressure on its forward facing working surface 206. The piston 106 thus moves back to its closed position, closing the passage between chamber A and chamber B.

With the passage between chambers A and B now closed, the pressure in chamber B works to move the bolt forward as it continues to expand in a chamber whose volume is increasing. This is depicted in FIG. 7. In this example, both chamber A and chamber C operate at the same pressure. Accordingly, since the area of the backward facing working surface of the bolt 103 is larger than the forward facing surface in chamber C, the force applied in chamber B on the bolt is higher such that the bolt will move forward. Meanwhile, chamber A has been refilled with compressed gas. Finally, FIG. 7 also shows that as the bolt 103 moves forward, it pushes the projectile 114 from the breech region towards the barrel 113.

Figure 8:
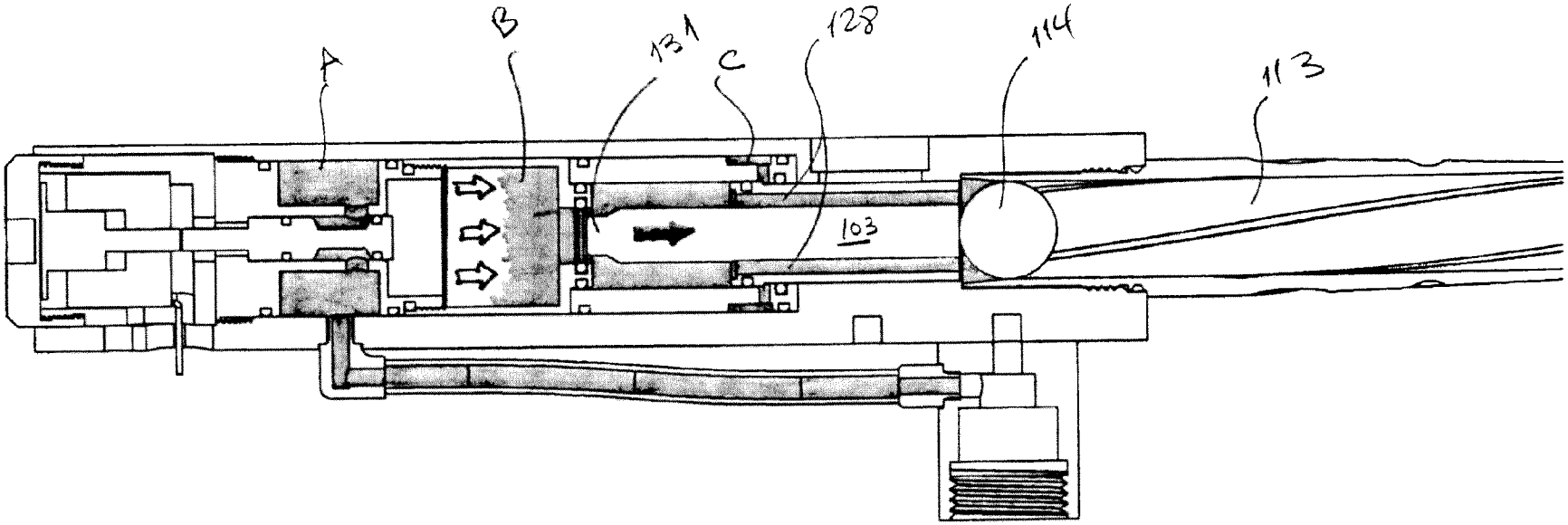

The bolt continues to move forward under pressure of chamber B to close the breech and load the paintball into the barrel 113. Once the distance needed to close the breech has been met, the bolt 103 which has been designed with a smaller back portion 131, allows the compressed gas in chamber B to expel, as depicted in FIG. 8, into a space defined by the bolt housing 409, where this space is in front of the opening formed in the front chamber housing 408. At this point, depicted in FIG. 7, chamber B is open once again, such that the compressed gas therein is released into the space that is adjacent in the bolt sleeve 409, and then moves through the gas passages 128 that are within the bolt 103. Once the projectile 114 has been launched, the chamber B is now empty of compressed gas such that the pressure in chamber C forces the forward facing working surface of the bolt 103 to move backwards, thereby moving the bolt 103 to its rear most position. The marker is now ready for a new launch cycle, with a new projectile being seated in the breech region.

Although pneumatic force (e.g., generated using compressed gas from a relatively small canister for a paintball marker, not shown) is used in the embodiment of the invention shown in FIG. 3 to both recoil the bolt and move the pilot that starts the launch sequence, there is essentially no wasted gas. For example, there is no need to purge any chambers into the atmosphere (other than the volume of gas that actually propels the paintball) in order to recoil the bolt. This also saves a certain amount of time that would otherwise be needed to purge a chamber. Accordingly, a tangible benefit in terms of both gas efficiency and greater speed of operation for firing a sequence of two or more shots, may be achieved.

The invention is not limited to the specific embodiments described above. For example, even though all of the figures above show a paintball as the projectile, most if not all of the concepts described above may be adapted for pneumatically launching other types of projectiles, such as lead pellets. In another instance, the coil assembly 413 and piston 106 could be positioned vertically within a trigger frame of the device, rather than horizontally, or in-line, with the chamber B and the bolt 103. This may help shorten the length of the device. Accordingly, other embodiments are within the scope of the claims.

What is claimed is:

1. A method for operating a pneumatic gun, comprising:

loading a plurality of projectiles sequentially into a breech region of the gun; and launching the plurality of projectiles sequentially from the breech region using a volume of compressed gas to propel the projectiles, wherein other than the volume of compressed gas needed to launch the projectiles, no chamber of the gun is purged of compressed gas during said loading and launching.

2. The method of claim 1 further comprising:

applying pneumatic pressure to substantially equally dimensioned forward facing and backward facing working surfaces of a piston to retain it in a rest state;

electrically actuating the piston to drive it to release gas from a first chamber into a second chamber.

3. The method of claim 2 further wherein expansion of the gas in the second chamber acts on a second forward facing working surface to return the piston to the rest state thereby sealing the first chamber and acts on a backward facing working surface of a bolt to transition a projectile into a firing position.

4. The method of claim 3 further comprising:

releasing the gas from the second chamber when the projectile is in the firing position to propel the projectile from the pneumatic gun.

5. The method of claim 3 further comprising:

pressurizing a third chamber to apply pneumatic pressure on a forward facing working surface of the bolt.

6. The method of claim 5 further wherein the backward facing working surface of the bolt is greater in area than the forward facing working surface of the bolt.

* * * * *